United States Patent [19]

Murabito

[11] 3,978,603

[45] Sept. 7, 1976

[54] SAFETY FOR REVOLVERS

[76] Inventor: Frank Murabito, 64-24 80th Ave., Glendale, N.Y. 11227

[22] Filed: Apr. 28, 1975

[21] Appl. No.: 572,356

[52] U.S. Cl. ..... 42/66

[51] Int. Cl.[2] ..... F41C 17/00; F41C 1/00

[58] Field of Search ..... 42/66, 65, 62

[56] References Cited

UNITED STATES PATENTS

| | | | |
|---|---|---|---|
| 573,736 | 12/1896 | Wesson et al. | 42/62 |
| 635,705 | 10/1899 | Wesson et al. | 42/66 |
| 3,177,602 | 4/1965 | Geber | 42/62 |
| 3,422,559 | 1/1969 | Woloch | 42/66 |

*Primary Examiner*—Charles T. Jordan
*Attorney, Agent, or Firm*—Allison C. Collard

[57] ABSTRACT

A safety for revolvers comprising a revolver frame, having a recess therethrough, the recess being formed and having front and rear ends with at least one abutment catch intermediate the ends thereof. A firing assembly includes a hammer pivotally mounted in the frame and has a first portion pivotally operatively connected therewith. A thumbpiece is slidably disposed on the outside of the frame and projects through the recess. The thumbpiece includes an insert member slidably disposed in the recess and has at least one point substantially complementary to at least one abutment catch for releasable engagement thereagainst. A slide pin is displaceably disposed in the frame and connected to the thumbpiece for joint displacement therewith, yet mounted pivotally relative thereto. The slide pin has a second portion adjacent to the first portion of the hammer, the slide pin being movable between an operative position and an inoperative position. A cylinder disposed in the frame and operatively receiving the slide pin is in an operative position of the latter for retaining the cylinder in the frame, in the inoperative position of the slide pin, the latter being removed from the cylinder, whereby the cylinder is released and spring means operatively bias the thumbpiece and slide pin toward the abutment catch for holding the slide pin and thumbpiece thereagainst.

7 Claims, 12 Drawing Figures

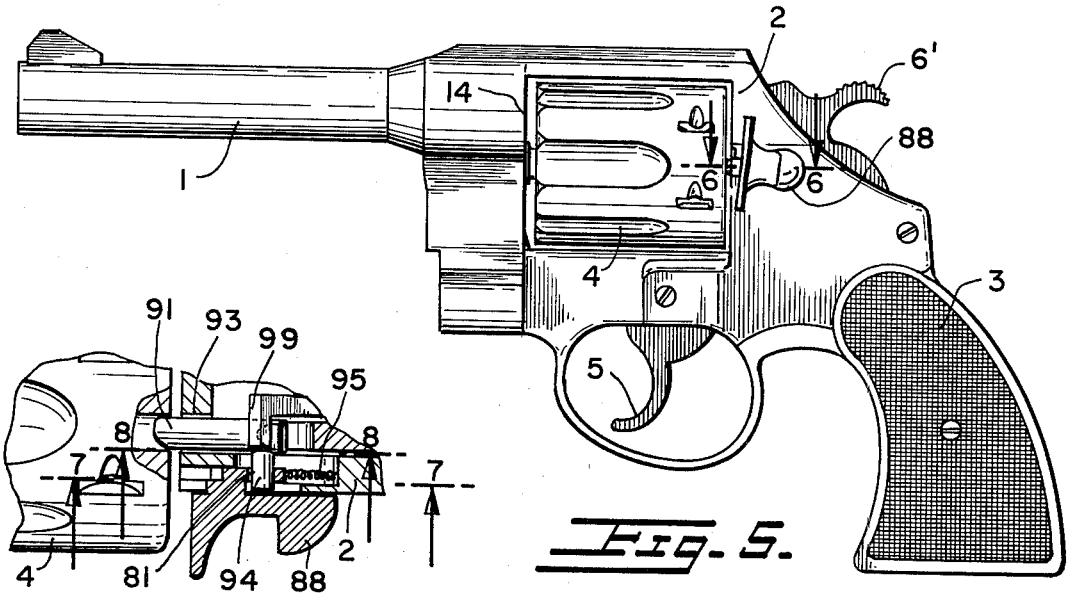
Fig. 5.
Fig. 6.
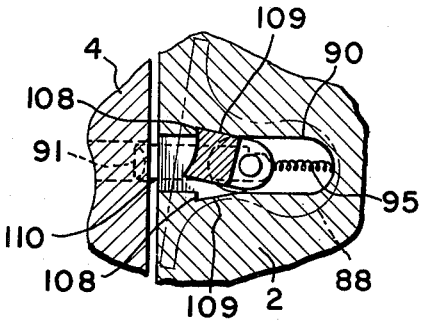
Fig. 7.
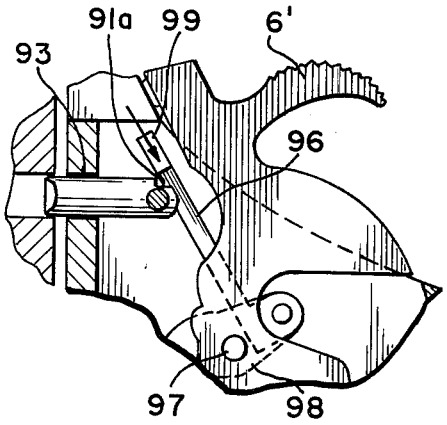
Fig. 8.
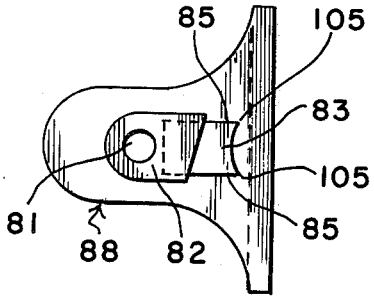
Fig. 10.
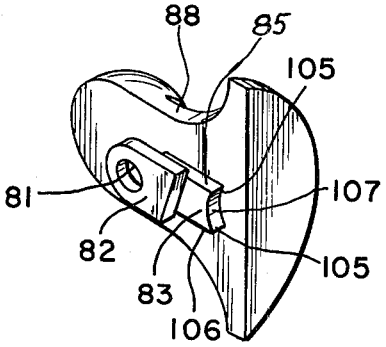
Fig. 9.

SAFETY FOR REVOLVERS

The present invention relates to revolvers, and in particular to a safety for revolvers.

Revolvers are generally not provided with any satisfactory safety. This presents a problem of accidental discharge of the revolver, while in a holster or otherwise. The problem with the design of such a safety device has been one of weight and space, since a revolver has to be designed to have a minimum weight and space. Heretofore, there has been no satisfactory non-cumbersome safety for a revolver which will prevent the revolver from accidentally firing when it is fully loaded and otherwise in a ready condition for use.

It is a first object of the present invention to provide a safety device for revolvers which can inactivate the hammer when the cartridge cylinder is in the fully loaded position.

It is another object of the present invention to provide a safety for revolvers which is extremely compact and lightweight, constituting simply a modification of the conventional revolvers, operates satisfactory to achieve the function desired, and is inexpensive to make.

It is yet another object of the present invention to provide a safety for revolvers utilizing, with modification according to the invention, the known structure already in a revolver for releasing the cylinder, to achieve a locking of the hammer.

Known revolvers, such as Colt and Smith & Wesson, are provided with a thumbpiece for releasing the cartridge cylinder for loading. It has been found by the present inventor that if such thumbpiece could be held in certain positions, it would interfere with the movement of the hammer, as an operative safety.

Accordingly, it was another object of the present invention to provide an improvement of the structure of the thumbpiece, to provide a safety for locking the hammer in an operatively loaded position of the cylinder, yet with minor modifications to the revolvers without additional parts, even with yet reduced weight, providing a new safety function not heretofore achieved in revolvers. Accordingly, the present invention may be used with newly manufactured revolvers, or revolvers already in use may be modified with relative ease to be equipped with the device of the present invention.

Still further, a safety is known for a Colt revolver in which an inclined cartridge pin is provided mounted on an assembly operatively connected with the hammer, such that when the cartridge is not fully inserted but partially inserted, the pin is locked against the rebound slide pin, thereby preventing the hammer from being actuated.

It is another object of the present invention to improve a Colt gun having the above-mentioned safety such that the safety can also be operative while the revolver is fully loaded and the cartridge cylinder is in the completely operative position.

Other objects and features of the present invention will become apparent from reference to the drawings which disclose a preferred embodiment to the gun in accordance with the present invention, of which:

FIG. 5 is a side view of a Colt revolver;

FIG. 6 is a section taken along the line 6—6 of FIG. 5;

FIG. 7 is a section taken along line 7—7 of FIG. 6;

FIG. 8 is a section taken along the line 8—8 of FIG. 7;

FIG. 9 is a perspective view of the thumbpiece of FIG. 10; and

FIG. 10 is a side elevation view of the thumbpiece in accordance with the present invention.

Figure 1:
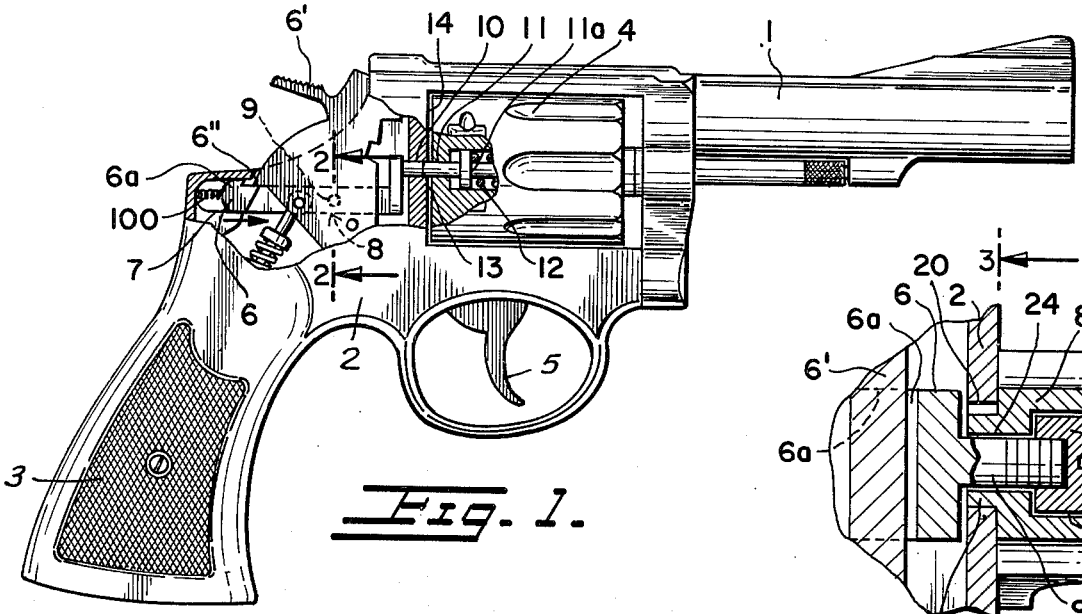
FIG. 1 is a side elevation view of a conventional Smith & Wesson revolver partially broken away.

Referring now to the drawings, and more particularly to FIG. 1, a Smith & Wesson revolver is illustrated showing a body 2 having a barrel 1 connected to the body 2 and having a handle 3 connected at the rear end thereof and mounting a cylinder 4 which contains the ammunition. A trigger 5 is operatively connected to a pivot of hammer 6' by a known mechanism which causes the actuation and firing of the revolver. As is conventional, when the cylinder 4 is to be reloaded, a rebound slide pin 6 which is disposed in a longitudinal slot 7 in the housing, is moved in a direction toward the barrel by sliding a thumbpiece 8 slidably mounted on the outside of the gun toward the barrel 1. The thumbpiece is operatively connected by a pin 9 to the rebound slide pin 6. The end of the rebound slide pin 6 facing the barrel, is provided with a pin 10 thereon which abuts a coaxially disposed pin 11 in the cylinder 4, the latter being spring biased against the pin 10 by a compression spring 12 abutting a cylindrical portion **11*a* integral with the pin 11 and an abutment in the cylinder (not shown) as conventional. A compression spring 100 is also provided on the rear end of the rebound slide pin 6 biasing the rebound slide pin toward the barrel 1 into engagement with the pin 11. However, the compression spring 12 is stronger than the compression spring 100 causing the interface 13 to be displaced in the position of FIG. 1 toward the back relative the recess 14 of the housing. The interface 13 is defined at the abutting portions of the pins 10 and 11, and when the slide thumbpiece 8 is moved toward the barrel, the rebound slide pin 6 displaced therewith is moved toward the barrel 1 until the interface 13 lies in the recess 14 of the housing in which the cylinder 4 is disposed. In this position, the cylinder 4 may be turned out of the recess 14** to the extent necessary for reloading ammunition therein.

Figure 2:
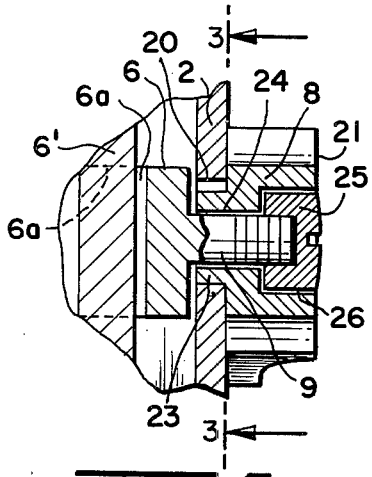
FIG. 2 is a section along line 2—2 of FIG. 1.
Figure 3:
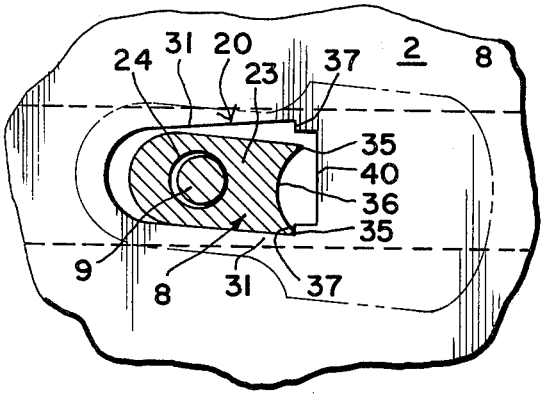
FIG. 3 is a section along line 3—3 of FIG. 2, showing the position of the thumbpiece in accordance with the present invention as a safety when the gun is loaded.
Figure 4:
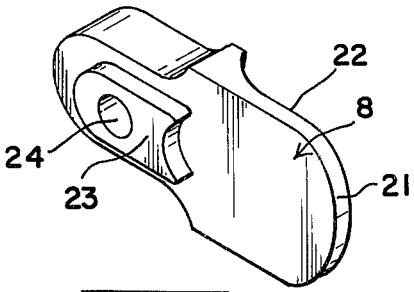
FIG. 4 is a perspective view of the thumbpiece in accordance with the present invention.

In accordance with the present invention, a corresponding side wall of the housing 2 is provided with a special keystone-shaped recess 20 through which the thumbpiece 8 extends. Referring now more particularly to FIGS. 2–4, the thumbpiece 8 is formed in two integral parts. A first part 21 thereof is formed similar to that of the conventional thumbpiece and has an outer surface 22 forming knurled notches which is easily used for sliding the thumbpiece by a person's thumb, and an insert portion 23 integrally connected to the portion 21, which portion 23 enters in the keystone-shaped recess 20 of the housing 2 of the revolver. The pin 9, which is integrally connected to a side of the rebound slide pin 6, passes through an opening 24 of the portions 21 and 23 and is secured on its outer end at the side of the gun by a thumbpiece nut 25 which is counter-sunk in a recess 26 of the portion 21 of the thumbpiece 8, the pin 9 being threaded therefor at its end adjacent the outside of the gun (note FIG. 2).

In accordance with the present invention, the keystone groove 20 in which the smaller size portion 23 of the thumbpiece 8 is disposed, is elongated in a direction parallel to the rebound slide pin 6 and to the longitudinal slot 7. By means of the nut 25 and the pin 9, the slidable thumbpiece 8 is secured for joint movement with the rebound slide pin 6. The front portion of the recess 20 is formed substantially semicircularly complementary to the semicircular forward end portion of the insert portion 23 of the thumbpiece. The longitudinal sides 30 of the longitudinally extended insert portion 23 are substantially parallel to one another. The corresponding longitudinal sides 31 of the recess 20 diverge in a direction towards the handle 3 of the revolver and form, adjacent to the longitudinal edges 30 of the insert portion 23 of the thumbpiece 8, lateral spaces 34 as may be seen in FIG. 3B, permitting the thumbpiece 8 to be pivoted either upwardly or downwardly, the latter position being shown in FIG. 3. The rear portion of the insert portion 23 of the thumbpiece 8, which points toward the handle 3 of the revolver, is formed with two points 35 adjacent the longitudinal edges 30 thereof, and therebetween the insert portion 23 is formed with an inwardly directed arcuate semicircular recess 36. Adjacent the widest portion of the recess 20 facing the handle 3, the recess forms stepped abutment catch surfaces 37, corresponding in position adjacent to the points 35 of the insert portion 23 of the thumbpiece 8, which abutment catch surfaces 37 are adapted to hold the thumbpiece 8 in the position shown in FIG. 3 with the lowermost point 35 of the insert piece 23 engaging and held against the bottom of abutment 37, or in an upper position (not shown) with the upper point 35 of the insert piece 23 being held against the upper abutment portion 37 of the recess 20. The longitudinal walls 31 and the abutment steps 37 cooperatively form a recess at the bottom and the top, respectively, for the respective points 35 of the insert piece 23 of the thumbpiece 8.

Figure 3A:
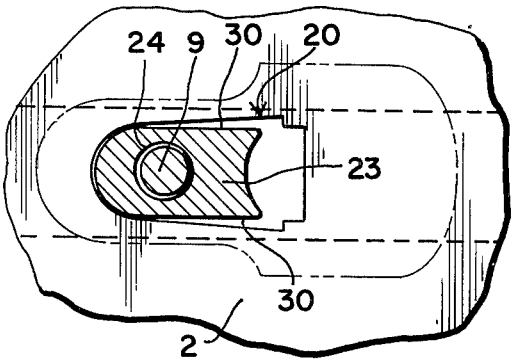
FIG. 3A is a view similar to that of FIG. 3 but showing the thumbpiece in the position to withdraw the cylinder for loading.
Figure 3B:
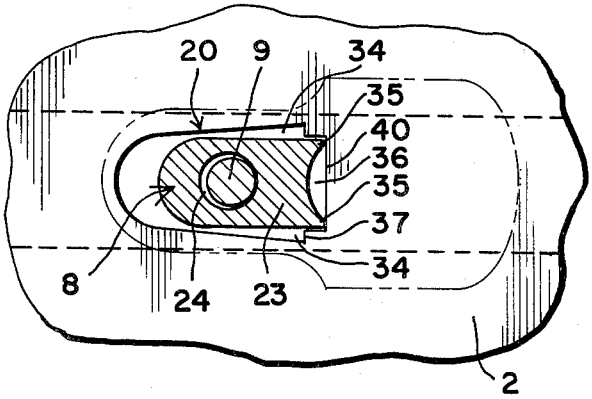
FIG. 3B is a section similar to that of FIG. 3A but showing the thumbpiece in position for firing of the gun.

The spring 12 operatively presses the pins 9 and 10, the rebound slide pin 6, and thus therewith, the thumbpiece 8 and the insert piece 23 toward the rear of the revolver, thus biasing the points 35 toward the rear (i.e., to the right as shown in FIGS. 3, 3A and 3B). In this manner, the points are held in one of the positions shown in FIG. 3 or in a position where the point 35 is in the upper abutment 37 of FIG. 1 (not shown). The position of FIG. 1 corresponds to that of FIG. 3, and it is seen that in this position, the hammer 6' of the gun is locked from pivoting since in this position flange portion 6a of the rebound slide pin is disposed in blocking position directly below the hammer edge 6'' of the hammer 6'.

The rear end of the recess 20 adjacent abutments 37 is formed substantially of a width equal to, but slightly larger, than the width of spacing between the sides 30 of the insert piece 23, as may be seen in FIG. 3B. Accordingly, the points 35 of the insert piece 23 can be against the end wall 40 of the recess 20, whereby the thumbpiece 8 is also used as in the conventional thumbpiece. Here the thumbpiece 8 is fully rearwardly biased by the spring 12, whereby the revolver is in the operative use position. For loading the cylinder 4, the thumbpiece 8 is moved toward the muzzle or barrel against the force of the spring 12 so that the semicircular portions of the recess 20 and the insert piece 23 are in engagement such as shown in FIG. 3A. In the safety position of FIGS. 1 and 3 in accordance with the present invention, the flange 6a of the rebound slide pin 6 is beneath the hammer 6', and preventing the latter from operative pivotal movement.

The two points 35 and two abutments 37 permit the safety locking either in the pivotally upward position or the pivotally downward position, the latter being shown in FIG. 3, so that when a person sets the safety in one of the two safety positions, another person does not know which position the insert member is locked, and cannot release it quickly. The insert member 23 is pivotally connected to the rebound slide pin 6, permitting the relative pivotal movement of the insert piece 23 in the slot 20. In this respect, the opening 24 in the insert member 23 is slightly larger than the pin 9, permitting a relative pivotal movement thereabout.

Referring now to the drawings and more particularly to FIGS. 5–10, a colt revolver is illustrated having a barrel 1 connected to a revolver frame or housing 2 to which is secured a handle 3. A hammer 6' is operatively connected to a trigger 5 and to the firing mechanism of the revolver. A cylinder 4 for the ammunition cartridges is disposed in a recess 14 in the frame 2. A thumbpiece 88 is provided for releasing the cylinder 4 so that the latter may be swung out for loading.

The thumbpiece 88 is disposed on a side of the frame 2 and is formed with a connecting portion 82, having a hole 81 therein, which is inserted in a recess 90 in the frame 2. A latch pin detent assembly 91, which extends in normal use position of the revolver into the cylinder 4, and is longitudinally displaceable in a opening 93 in the revolver, has integrally connected therewith, and laterally depending therefrom, a projecting pin 94 which enters into the opening 81 of the portion 82 of the thumbpiece 88 with clearance so that the thumbpiece 88 may be pivoted relative thereto. A spring 95 biases the thumbpiece 88 in a direction into the cylinder 4. In this position, the thumbpiece 88 is at its left most position in FIG. 7 and the cylinder 4 is held in place; and the revolver is operative. In order to release the cylinder 4 for loading, the thumbpiece 88 is pressed rearwardly toward the handle 3 against the arcuate portion of the recess 90 against the face of the spring 95, and removing the latch pin detent assembly 91 from the cylinder, whereby the cylinder may be swung open for loading. Further, in accordance with the conventional operation, a safety member 96 is provided, operatively connected at a pivot point 97 to a safety lever 98 which is operatively connected to the hammer 6'. The safety assembly 96 is provided with a lateral right angle extending flange 99. In a normal firing operation, as the hammer 6' is pivoted back, the therewith connected safety assembly 96 moves downwardly as shown by the arrow in FIG. 8. Any prevention of this downward movement of the safety assembly 96 locks the hammer and thus prevent the gun from firing. The latch pin detent assembly 91 has a chiseled end 91a which is adapted to cooperate and engage underneath the flange 99 of the safety assembly member 96, thereby preventing the hammer 6' from pivotal movement and thereby acting as a safety lock. This safety position in the conventional device only occurs when the thumbpiece 88 is pulled rearwardly into the arcuate position of the recess 90 against the effect of the spring 95 during loading, and particularly after the cylinder has been loaded and is being swung back into the recess 14 of the frame 2, the latch pin detent assembly 91 then being pushed rearwardly by the inserting cylinder, thereby preventing at this time any inadvertent accidental firing of the revolver.

In accordance with the present invention, the improvement comprises a modification of the above safety assembly, whereby also during operation of the revolver after the cylinder is completely inserted and otherwise ready for use, the safety may be used, which was not possible heretofore.

In accordance with the improvement of the present invention, the thumbpiece 88 is pivotally mounted about the pin 94 which enters in the opening 81, the latter being slightly larger than the pin 94, permitting relative pivotal movement of the thumbpiece thereabout. Likewise, as in the first embodiment, the thumbpiece 88 is formed with an insert portion 83 which enters in the recess 90 of the frame 2, the insert piece 83 being formed here, at its forwardmost portion facing the barrel with two points 105 adjacent upper and lower parallel edges 85 thereof, and between the points 105 having a substantially semicircular recess surface 107. Correspondingly, the recess 90 in the frame 2 is formed adjacent at its barrel end 110 with inwardly directed abutment steps 108 at the top and bottom thereof adjacent the widest portion thereof formed by forwardly diverging upper and lower walls 109 of the recess 90. Thus, in this intermediate position, the insert piece 83 may be pivoted, by rotation of the thumbpiece 88 into an upward position as shown in FIG. 7, wherein the point 105 catches in the top abutment stop 108. In this intermediate position, likewise as when the lower point 105 is pivoted into the bottom abutment stop 108 (not shown), the latch pin detent assembly 91 still enters the cylinder 4 (as shown in FIG. 8) holding the cylinder 4 in normal position. However, as illustrated in FIG. 8 which corresponds to the position of FIG. 7, the chiseled end 91*a* of the latch pin detent assembly 91 enters under the flange 99 of the safety assembly 96, thereby preventing the hammer 6' from pivotal actuation. This is the locking safety position in accordance with the present invention. The revolver though loaded and otherwise operative cannot fire.

On the rear end, the thumbpiece 88 is formed semicircularly complementary to a semicircular rear end of the opening 90, whereby the thumbpiece can be pressed back to permit withdrawal of the latch pin detent assembly 91 from the cylinder 4 for releasing the latter for loading. Likewise, in the operative use position, the thumbpiece 88 is aligned with the recess 90 and the spring 95 biases the thumbpiece against the front end 110 of the recess 90, the front portion of the recess 90 being formed at least equal to the width between the longitudinal sides 106 of the insert 83 so that both points 105 enter into the front portion of the recess 110, whereby the gun is in normal firing position. Herein, the latch pin detent assembly 91 and the rebound slide pin 6 are generically defined as a slide pin.

While only two embodiments of the present invention have been shown and described, it will be obvious to those of ordinary skill in the art that many changes and modifications may be made thereunto without departing from the spirit and scope of the invention.

What is claimed is:

1. A safety for revolvers comprising:

a revolver frame, having a recess therethrough, said recess being formed having front and rear ends with at least one abutment catch intermediate the ends thereof;

a firing assembly including a hammer pivotally mounted in said frame and having a first portion pivotally operatively connected therewith;

a thumbpiece slidably disposed on the outside of said frame and projecting through said recess, said thumbpiece including an insert member slidably disposed in said recess and having at least one point substantially complementary to said at least one abutment catch for releasable engagement thereagainst;

a slide pin displaceably disposed in said frame and connected to said thumbpiece for joint displacement therewith yet mounted pivotally relative thereto;

said slide pin having a second portion adjacent to said first portion of said hammer, said slide pin being movably between an operative position and an inoperative position;

a cylinder disposed in said frame and operatively receiving said slide pin in an operative position of the latter for retaining said cylinder in said frame, in said inoperative position of said slide pin, the latter being removed from said cylinder, whereby said cylinder is released; and spring means for operatively biasing said thumbpiece and slide pin toward said abutment catch for holding said slide pin and thumbpiece thereagainst.

2. The safety for revolvers as set forth in claim 1, wherein:

said at least one abutment catch and said at least one point constitutes an upper and lower of each; and said insert member is formed with a recess between said two points.

3. The safety for revolvers as set forth in claim 2 wherein:

said spring means pushes said slide pin in a direction toward a rear of said revolver;

said abutment catch is formed adjacent a rear of said recess; and said recess is formed with upper and lower longitudinal walls diverging in a direction toward and up to said abutment catch in a direction toward the rear of said revolver, wherein the width between said diverging longitudinal walls of said recess is substantially larger than the width of said insert member, whereby the latter can be pivoted in said recess.

4. The safety for revolvers as set forth in claim 3, wherein the longitudinal sides of the insert member are parallel.

5. The safety for revolvers as set forth in claim 2 wherein:

said spring biasing means biases the insert member in a direction towards a front of the revolver and said at least one abutment catch is formed at a front portion of said recess, the latter including diverging longitudinal walls with the widest point thereof adjacent said abutment catch, said longitudinal walls diverging in a direction toward the front of said revolver, said insert member being narrower than the width of said recess whereby said insert member can be pivoted in said recess.

6. The device as set forth in claim 4, further comprising:

a pin integrally connected to said slide member; and said slide member is pivotally connected to said thumbpiece by said pin, the latter enters in an opening in said thumbpiece, said opening being larger than said pin, whereby said pivotal movement is achieved.

7. In a revolver comprising a revolver frame, having a recess therethrough; a firing assembly including a hammer pivotally mounted in said frame and having a first portion pivotally operatively connected therewith; a thumbpiece slidably disposed on the outside of said frame and projecting through said recess, said thumbpiece including an insert member slidably disposed in said recess; a slide pin displaceably disposed in said frame and connected to said thumbpiece for joint displacement therewith yet mounted pivotally relative thereto; said slide pin having a second portion adjacent to said first portion of said hammer, said slide pin being movable between an operative position and an inoperative position, a cylinder disposed in said frame and operatively receiving said slide pin in said operative position of the latter for retaining said cylinder in said frame, and in said inoperative position of said slide pin, the latter being removed from said cylinder whereby said cylinder is released; and spring means for operatively biasing said thumbpiece and slide pin into said operative positions; the improvement comprising a safety wherein:

said recess being formed with front and rear ends with at least one abutment catch intermediate said ends thereof;

said insert member having at least one point substantially complementary to said at least one abutment catch for releasable engagement thereagainst; and said spring means for operatively biasing said insert member toward said at least one abutment catch for holding said at least one point thereagainst.

* * * * *